US007856996B2

(12) United States Patent
Ma

(10) Patent No.: US 7,856,996 B2
(45) Date of Patent: Dec. 28, 2010

(54) LIGHT SUPPORT ADAPTER

(75) Inventor: Oliver Joen-an Ma, 29 W. Wisteria, Arcadia, CA (US) 91007

(73) Assignee: Oliver Joen-an Ma, Arcadia, CA (US)

( * ) Notice: Subject to any disclaimer, the term of this patent is extended or adjusted under 35 U.S.C. 154(b) by 194 days.

(21) Appl. No.: 12/167,881

(22) Filed: Jul. 3, 2008

(65) Prior Publication Data

US 2009/0007945 A1 Jan. 8, 2009

Related U.S. Application Data

(60) Provisional application No. 60/948,431, filed on Jul. 6, 2007.

(51) Int. Cl.
*A45B 3/02* (2006.01)

(52) U.S. Cl. ..... 135/16; 135/21; 135/91; 135/901; 362/102

(58) Field of Classification Search ..... 135/16, 135/21, 20.1, 910, 90, 91, 94, 135; 362/417–419, 362/102, 396
See application file for complete search history.

(56) References Cited

U.S. PATENT DOCUMENTS

| | | | | |
|---|---|---|---|---|
| 2,547,896 | A | 4/1951 | Wellen | |
| 2,953,145 | A * | 9/1960 | Moss et al. | 135/98 |
| 3,929,146 | A * | 12/1975 | Maiken | 135/98 |
| 5,216,948 | A * | 6/1993 | Sheppard et al. | 99/483 |
| 5,331,524 | A | 7/1994 | Tseng | |
| 5,463,535 | A | 10/1995 | Vest | |
| 5,499,646 | A * | 3/1996 | Lee | 135/121 |
| 6,196,242 | B1 * | 3/2001 | Xu | 135/20.1 |
| 6,230,728 | B1 * | 5/2001 | Reese | 135/98 |
| 6,401,735 | B1 * | 6/2002 | Chou | 135/20.1 |
| 6,439,249 | B1 | 8/2002 | Pan | |
| 6,598,990 | B2 | 7/2003 | Li | |
| 6,666,224 | B2 * | 12/2003 | Lee | 135/16 |
| 6,692,135 | B2 | 2/2004 | Li | |
| 6,830,058 | B2 | 12/2004 | Li | |
| 6,923,194 | B2 | 8/2005 | Li | |
| 6,966,667 | B2 | 11/2005 | Li | |
| 7,013,903 | B2 | 3/2006 | Li | |

(Continued)

FOREIGN PATENT DOCUMENTS

DE 4407188 C1 * 12/1994

(Continued)

OTHER PUBLICATIONS

European Search Report received in corresponding European Application No. 08252293.9, mailed Jan. 9, 2009, 6 pages.

*Primary Examiner*—Winnie Yip
(74) *Attorney, Agent, or Firm*—Knobbe Martens Olson & Bear, LLP

(57) ABSTRACT

A light support system is provided for a structure for supporting a light device thereon. The system can comprise a deployable member and a retention mechanism. The deployable member can have an exterior surface onto which the light device can be mounted. The deployable member can be selectively movable from a stowed position to an extended position in which the member can support the lighting device. The member can be engaged in order to retain or lock the member in at least one of the stowed and extended positions.

33 Claims, 12 Drawing Sheets

U.S. PATENT DOCUMENTS

| | | | | |
|---|---|---|---|---|
| 7,108,388 | B2 | 9/2006 | Li | |
| 7,156,114 | B2 * | 1/2007 | Lo | 135/21 |
| 7,174,908 | B2 * | 2/2007 | Chen | 135/135 |
| 7,331,684 | B2 * | 2/2008 | Tung | 362/102 |
| 7,481,547 | B2 * | 1/2009 | Li | 362/102 |
| 2005/0117326 | A1 | 6/2005 | Ma | |
| 2005/0146876 | A1 | 7/2005 | Li | |
| 2005/0254228 | A1 | 11/2005 | Li | |
| 2006/0266398 | A1 * | 11/2006 | Wu | 135/91 |
| 2007/0151588 | A1 * | 7/2007 | Yul et al. | 135/91 |

FOREIGN PATENT DOCUMENTS

| | | | |
|---|---|---|---|
| FR | 2752512 | A1 * | 2/1998 |
| JP | 2002242487 | A * | 8/2002 |
| WO | WO 2004/102063 | | 11/2004 |

* cited by examiner

LIGHT SUPPORT ADAPTER

CROSS-REFERENCE TO RELATED APPLICATIONS

This application claims the benefit of U.S. Provisional Application No. 60/948,431, filed Jul. 6, 2007, the entirety of which is incorporated herein by reference.

BACKGROUND

1. Field of the Inventions

The present inventions relate generally to an outdoor shade structure such as an outdoor umbrella, gazebo, or pavilion. More specifically, the present inventions relate to a light support adapter, used in conjunction with an outdoor shade structure, mounted on a light support adapter that can be stowed into the body of the outdoor structure such that the adapter is hidden from view.

2. Description of the Related Art

Outdoor shade structures are commonly used in beaches, patios, campsites and other places for shading sunlight in the daytime. During nighttime use, many of these structures can be used to support lighting devices that illuminate the area underneath and around the structure. Sometimes, the structures are configured to accommodate removable lighting devices that can be mounted to a portion of the structure. The lighting devices are often mounted with the aid of a light support adapter that is attached to the structure. The lighting device then attaches to the adapter and can thereby be suspended from the main body of the structure to provide light to a desired area.

The light support adapter used with such a lighting device typically protrudes downwardly from an underside of the structure. As such, the adapter is visible to the naked eye, even when the illuminating unit is not mounted thereon. Other outdoor shade structures with lighting arrangements can be configured to accommodate a removable light support adapter. A removable adapter can be detached from the structure and stored at another location when the lighting device is dismounted.

SUMMARY

Although various lighting devices and adapters can be beneficially used, there remain several disadvantages associated with such products. For example, in accordance with an aspect of at least one of the embodiments disclosed herein is the realization that the light support adapter used to support a lighting devices on a shade structure, such as a pavilion or outdoor umbrella, often presents an inconvenient eyesore. In particular, a conventional non-removable light support adapter generally protrudes from the underside of the outdoor structure at all times, thus tending to reduce its aesthetic value. Furthermore, a non-removable protrusion of this sort can present an injury hazard to the user or passerby. In accordance with another aspect of at least one of the embodiments disclosed herein is the realization that even removable light support adapters can present problems because they may be easily lost or misplaced. Accordingly, removable light support adapters can create great inconveniences for the users when they are misplaced and may often need to be replaced.

Therefore, in accordance with the embodiment of the present inventions, there is provided a light support system for an outdoor structure. The outdoor structure can be an outdoor shade structure, such as an umbrella or pavilion, and can also include other structures such as frames, houses, eaves, etc. In some embodiments, the system can be integrated into the structure in order to provide an aesthetically pleasing and low profile product.

The system can comprise a deployable member and a retention mechanism. The deployable member can have an exterior surface and proximal and distal portions. The deployable member can be positionable, for example, in a chamber of the structure to assume a stowed position. The deployable member can be selectively movable from the stowed position to an extended position. Further, the exterior surface of the deployable member can be configured to support a lighting device when the deployable member is in the extended position. The exterior surface can also be configured to be engaged by an interior surface of the chamber of the outdoor shade structure when the deployable member is in the extended position.

In addition, the retention mechanism can be configured to facilitate locking and unlocking of the deployable member at least in the stowed position. The deployable member can be fixed relative to the shade structure when the retention mechanism locks the deployable member at least in the stowed position.

In some embodiments, the structure can comprise a hub having top and bottom ends and a plurality of pin apertures for engaging respective ones of ribs of an umbrella canopy support frame. The hub can define the central chamber into which the deployable member can be received. The central chamber can be configured to extend axially within the hub. Further, the hub can includes upper and lower portions disposed at the respective ones of the top and bottom ends of the hub. The upper portion can have a bottom surface that is configured to mate with a top surface of the lower portion. The upper and lower portions can define the plurality of pin apertures and the central chamber.

In other embodiments, the retention mechanism can be configured to be removably attachable to the distal portion of the deployable member. The deployable member can have a stop element disposed at the proximal portion thereof. Further, the deployable member can be insertable into a lower section of the chamber defined by the lower portion of the hub with the retention mechanism being attached to the deployable member such that the stop element and the retention mechanism limit longitudinal movement of the deployable member relative to the lower portion of the hub.

In accordance with yet another embodiment, a light is provided for mounting beneath a shade structure having a canopy, the canopy having an upper hub, a lower hub with a lower surface, and a hub longitudinal axis, the lower surface of the lower hub having a recess formed therein, the light comprising: an adapter having a first end engagable with the recess, a second end opposite the first end, and an outer surface between the first and second ends, the adapter extending along an adapter longitudinal axis and having a length between the first and second end such that the second end is beneath the lower hub but does not support the canopy in use; a housing having an inner sidewall surface defining an opening configured to receive the second end of the adapter such that the opening substantially surrounds the adapter longitudinal axis; at least one light source carried by the housing; and a clamp for engaging in use, the outside surface of the adapter in a direction substantially perpendicular to the axis of the adapter, the clamp extending in said direction from the inner sidewall surface.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENTS

In accordance with an embodiment of the present inventions, a uniquely configured light support system is provided that can be selectively positioned by a user in order to expose a mounting portion thereof to mount a light device thereon or to conceal the mounting portion for aesthetic purposes when not in use. The system can be used with any variety of indoor or outdoor support structures, such umbrellas, pavilions, and the like. The system is preferably sized and configured to provide an engageable contact surface whereto the light device can be mounted.

In some embodiments, the light support system can be stowable or nestable. For example, the system can be nestable into a portion of the support. It is also contemplated that the nested configuration of the system can be achieved when the system is at least partially retracted away from view or from obstruction. Thus, in some embodiments, the system can be positioned in an extended or deployed state and repositioned to a stowed or undeployed state. In this manner, the system can provide aesthetic and safety benefits by allowing the user to selectively reposition the system when the light device is used therewith and when the light device is removed. As described in greater detail herein, the system can incorporate various features that facilitate the repositioning of the system between the deployed and undeployed states.

Figure 1:
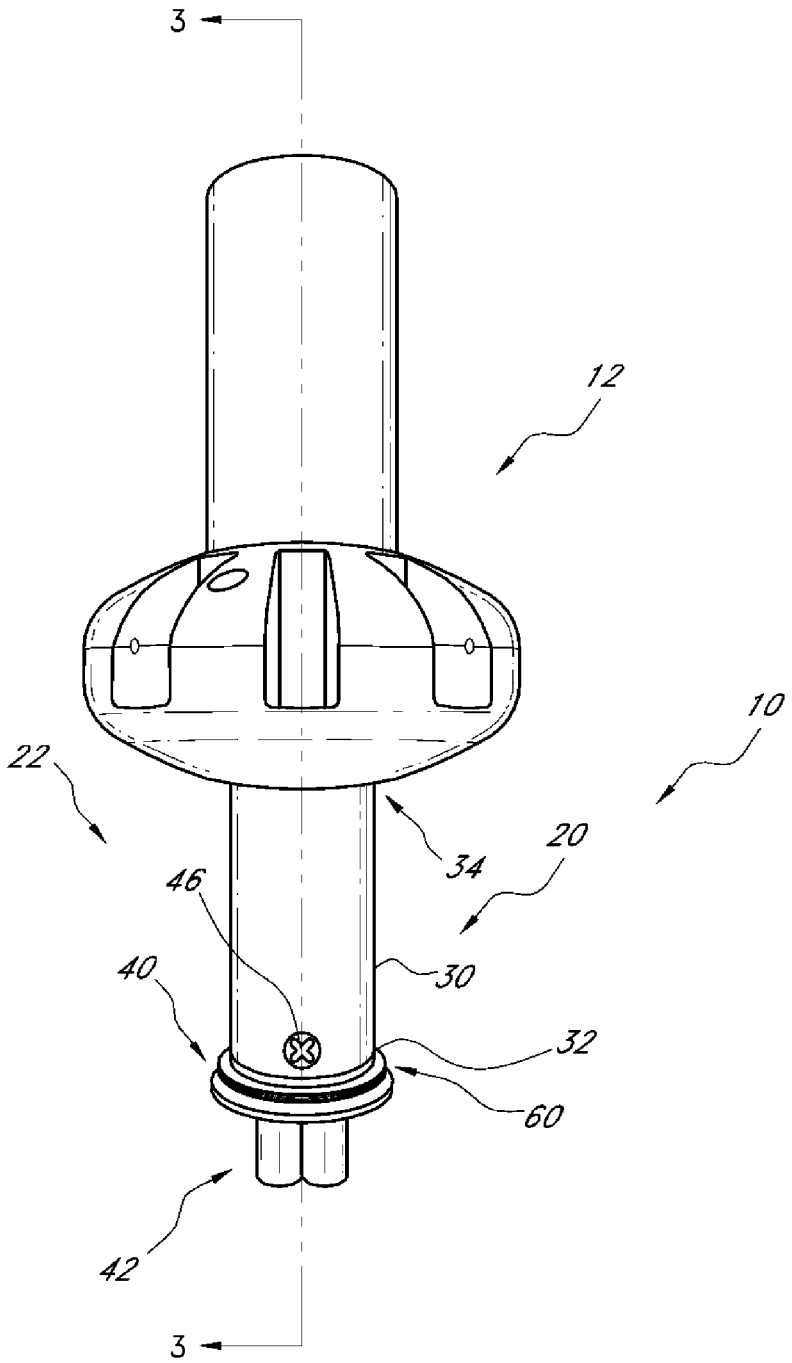
FIG. 1 is a side view of a light support system having a deployable member in a deployed position, according to an embodiment of the present inventions.

Referring now to the drawings wherein the showings are made for purposes of illustrating preferred embodiments of the present invention and not for purposes of limiting the same, FIG. 1 is a side perspective view of an exemplary embodiment of a light support system 10 that is coupled to a hub 12. As mentioned above, the light support system 10 can be used on an umbrella or other structure. Thus, the hub 12 can be a hub from an umbrella. However, the system 10 can be configured to be used with other such parts of suitable structures.

Figure 2:
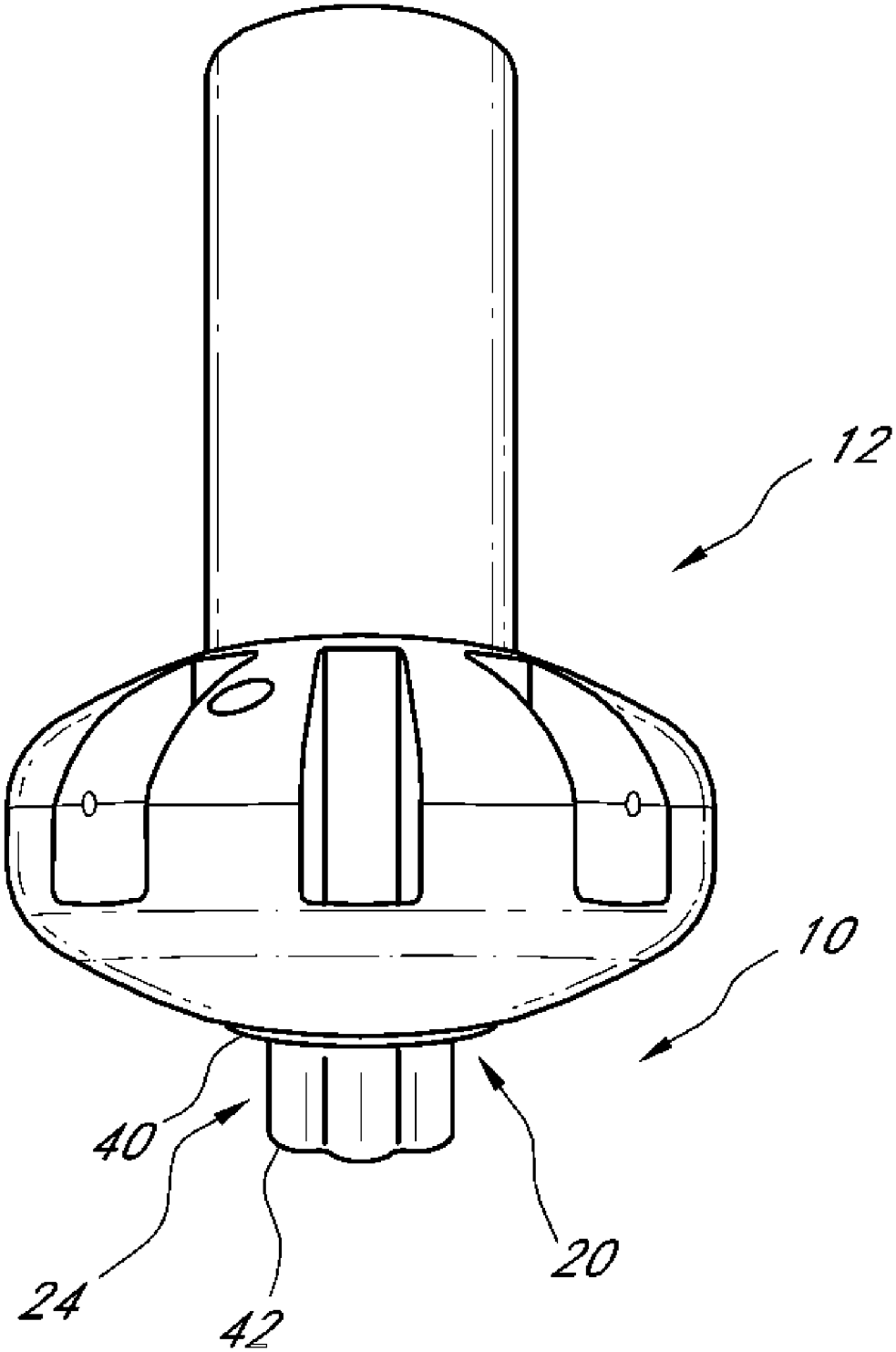
FIG. 2 is a side view of the light support system having a deployable member in a stowed position, according to another embodiment.
Figure 6:
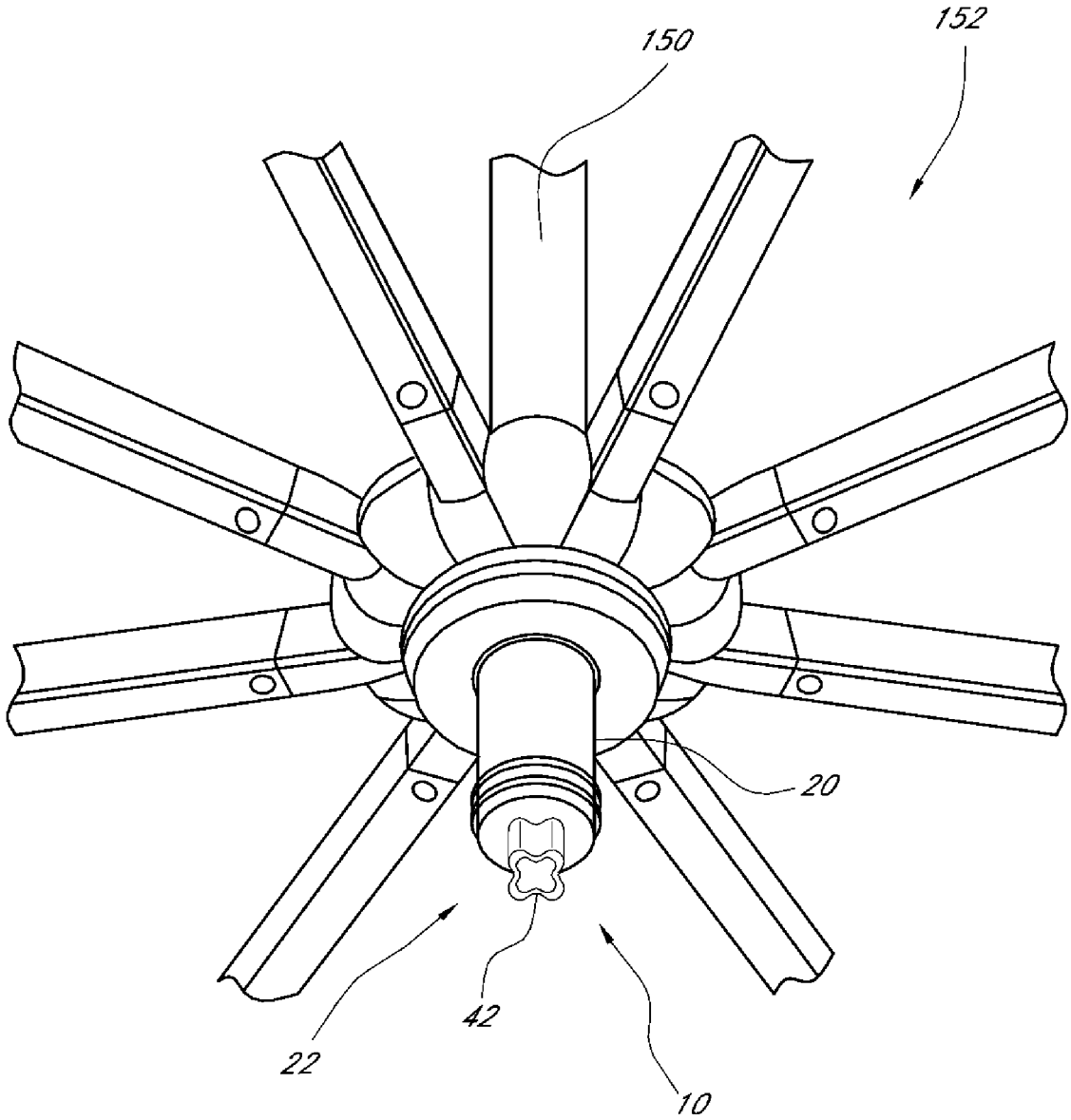
FIG. 6 is a perspective view of the light support system of FIG. 5 wherein the deployable member is in a deployed position, according to another embodiment.
Figure 7:
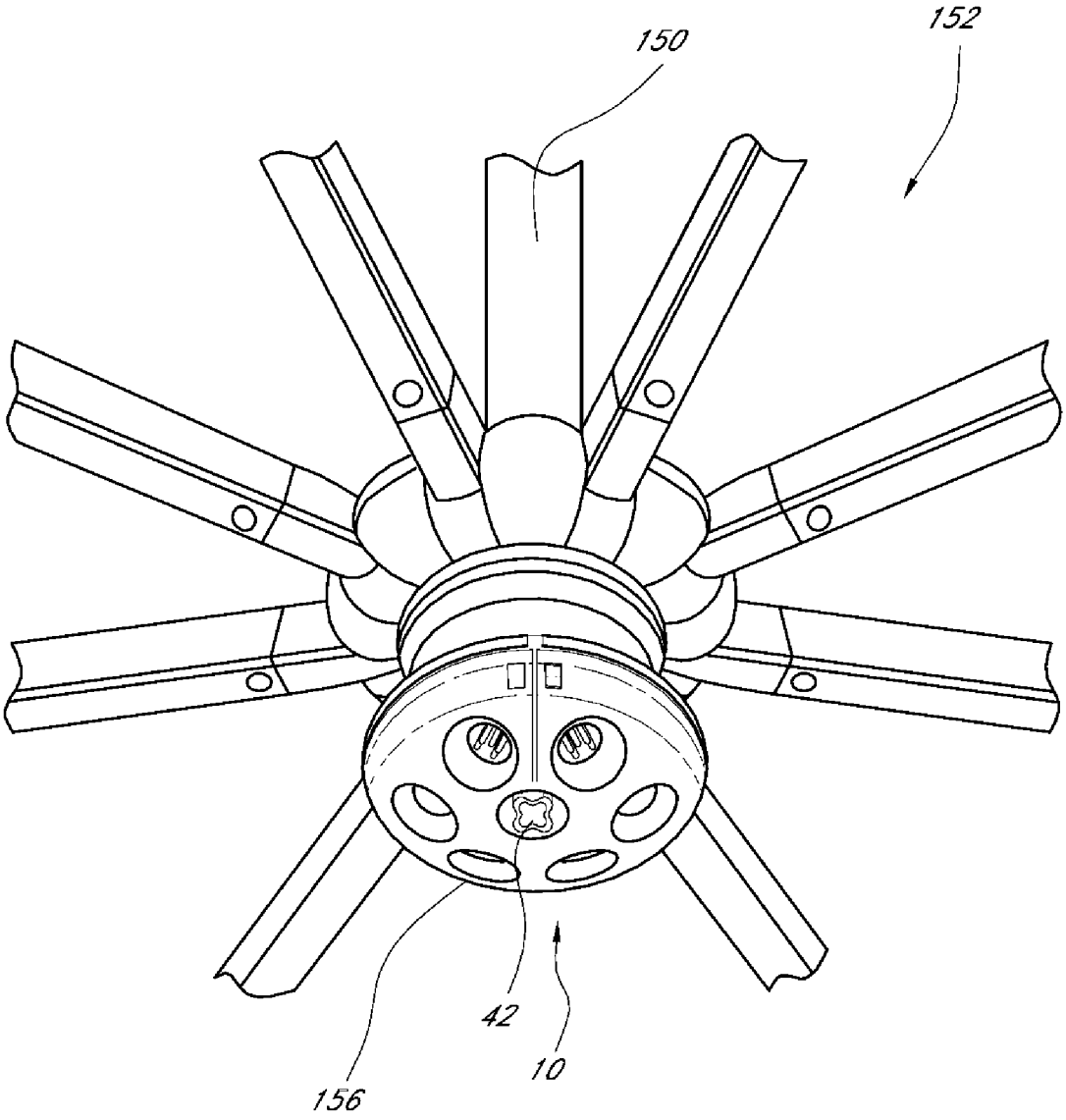
FIG. 7 is a perspective view of the light support system of FIG. 5 wherein the deployable member is in the deployed position, as shown in FIG. 6, and a light device is mounted on the deployable member, according to another embodiment.

In the illustrated embodiment of FIGS. 1-2, the system 10 comprises a deployable member 20. The deployable member 20 can be selectively positioned in a deployed or extended position 22, as shown in FIG. 1, or in an undeployed, nested, or stowed position 24, as shown in FIG. 2. The movement of the deployable member 20 from the undeployed position 24 to the deployed position 22 can be by means of translation and/or rotation, for example. As illustrated in FIGS. 1 and 2, it is contemplated that the deployable member 20 can descend from the hub 12. In such an embodiment, the hub 12 can be used on a cantilevered umbrella, as shown in FIGS. 6-8, and the deployable member 20 can be made available for supporting a light device thereon, as discussed further herein.

The deployable member 20 can define an exterior surface 30 and distal and proximal portions 32, 34. In some embodiments, the deployable member 20 can be configured as being substantially cylindrical. However, other shapes can also be utilized. As discussed above, the deployable member 20 can be selectively moved from the undeployed position 24 to the deployed position 22. As such, it is contemplated that the deployed position 22 can be obtained as the distal portion 32 of the deployable member 20 is moved away from the hub 12 or structure to which the deployable member 20 is connected. It is contemplated that the deployed position 24 may comprise a plurality of selectable positions that may correspond to given characteristics of the light device. For example, the deployable member 20 may be operative to deploy to a given position corresponding to a given light device, and to another given position corresponding to another given light device. Further, given positions of the deployable member 20 can correspond to needed characteristics of the system 10 in order to allow the system 10 to be used with other types of apparatuses, not only light devices. Such embodiments can be employed as desired. Furthermore, although the deployable member 20 is shown as a single section or length of material, the deployable member 20 can comprise a plurality of individual sections that can allow the deployable member 20 to deploy in a telescoping manner.

As illustrated in FIGS. 1-2, the system 10 can additionally comprise a retention mechanism 40 and an actuator element 42. The retention mechanism 40 can be used to facilitate the locking or unlocking of the deployment member 20 in at least one of the deployed and undeployed positions 22, 24. For example, when the deployment member 20 is in the undeployed position 24, as shown in FIG. 2, the retention mechanism 40 can be used to retain the deployable member 20 adjacent to the hub 12. Therefore, in some embodiments, the retention mechanism 40 can be disposed at the distal portion 32 of the deployable member.

As shown in FIG. 1, the retention mechanism 40 can be removably attachable to the distal portion 32 of the deployable member 20. In this regard, FIG. 3, the retention mechanism 40 can include an interior coupling section 44 that can be configured to mate with the distal portion 32 of the deployable member 20. In some embodiments, the attachment between the deployable member 20 and the retention mechanism 40 can be accomplished by means of a fastening element 46, such as a screw, bolt, adhesive, or other suitable fastener. The fastening element 46 can be disposed through apertures 48, 50 of the respective ones of the deployment member 20 and the retention mechanism 40.

It is contemplated that other means of attaching the retention mechanism 40 to the deployment member 20 can also be utilized, such as mating threaded sections, adhesives, other mechanical connections, and the like. Further, although the deployment member 20 and the retention mechanism 40 are shown in the illustrated embodiments as being separately formed, they can also be integrally formed from a continuous piece of material. For example, the retention mechanism 40 can be formed as a feature along the deployment member 20, such as at the distal and/or proximal portions 32, 34 thereof.

Figure 3:
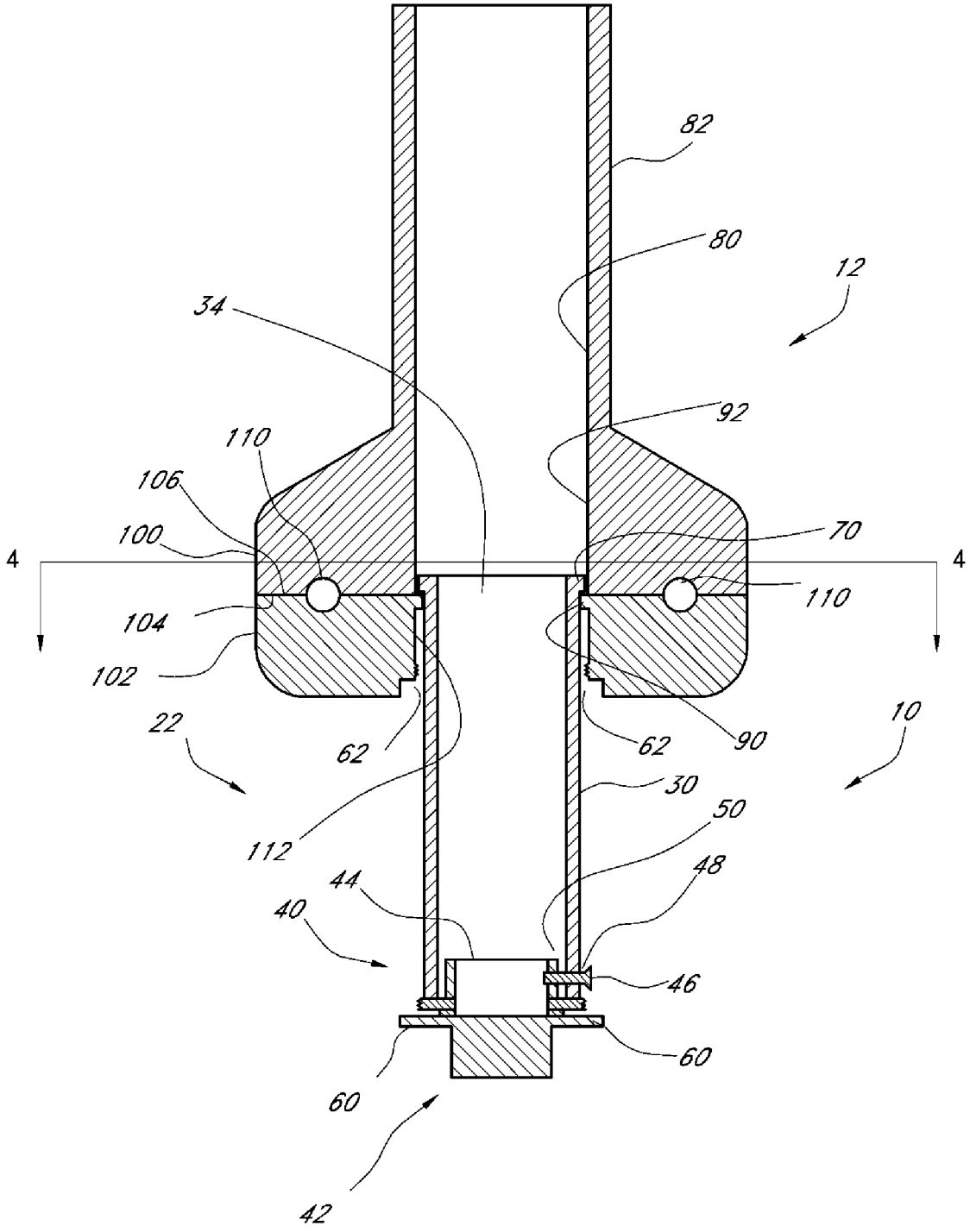
FIG. 3 is a cross-sectional view of the light support system taken along lines 3-3 of FIG. 1.

Referring again to FIGS. 1-3, the retention mechanism 40 can comprise a threaded section 60 that can be used to lock the deployable member 20 to the hub 12 when the deployable member 20 is in the stowed position, as shown in FIG. 2. As mentioned above, although the retention mechanism 40 is shown as being disposed at the distal portion 32 of the deployable member 20, the retention mechanism 40 can be disposed at any position along the length of the deployable member 20. Further, the retention mechanism 40 in some embodiments can comprise a complementary or mating structure that is disposed on the hub 12. For example, the threaded section 60 can mate with a complementary threaded section 62 of the hub, as shown in FIG. 3. However, in order to lock or retain a position of the deployable member 20, the outer surface 30 of the deployable member 20, or an interior surface or other portion thereof can be engaged by, or can itself engage, a portion of the structure or another part, such as a housing in which the deployable member 20 can be housed. Various configurations and modifications can be provided as well.

Accordingly, in some embodiments, the actuator element 42 can be configured to allow the user to easily rotate the deployable member 20 in order to lock or unlock the deployable member 20 in the undeployed position 24. As shown in FIGS. 1-2, the actuator element 42 can be a knob or comprise surface having a surface texture that facilitates gripping thereof. Additionally, the actuator element 42 can also allow the user to easily rotate the deployable member 20 in order to lock or unlock the deployable member in the deployed position 22, which would tend to fix the deployable member 20 in the deployed position 22. In this regard, the actuator element 42 can be used to facilitate movement of the deployable member 20 from the deployed position 22 to the undeployed position 24, and vice versa.

For example, to lock the deployable member 20 in the undeployed position 24, the actuator element 42 can be rotated in a clockwise fashion such that the threaded section 30 of the retention mechanism 40 mates with the corresponding threaded section 62 of the hub 12. Conversely, to release or unlock the deployable member 20, the actuator element 14 can be rotated in a counter-clockwise fashion such that the threaded section 60 of the retention mechanism 40 disengages from the corresponding threaded section 62 of the hub 12. As discussed above, just as the retention mechanism 40 can be disposed at any position along the length of the deployable member 20, the corresponding threaded section 62 (or other complementary or mating structure of the hub 12) can be similarly oriented in order to allow the retention mechanism 40 to be able to interact therewith. Further, it is also contemplated that in some embodiments, multiple complementary or mating structures of the hub 12 can be configured to interact with the retention mechanism 40 in order to allow the deployable member 20 to be adjustably positionable at a plurality of discrete deployed positions.

In other embodiments, the retention mechanism 40 can comprise a spring loaded release mechanism, for example, such as that used in a retractable ball point pen. In such embodiments, the actuator element 42 can be pressure sensitive and can be used to unlock the deployable member 20 from the undeployed position 24. Thus, the actuator element 42 can be operated by rotation and other forces, such as longitudinally applied pressure, pivoting of the actuator element 42, etc. Thus, in yet other embodiments, the retention mechanism 40 can comprise a latch that is actuatable by pivotal movement, where the actuator element 42 can facilitate the unlocking of the deployable member 20 by unlatching the retention mechanism.

Referring again to FIG. 3, a cross-sectional side view of the system 10 and the hub 12 of FIGS. 1-2 is shown. As illustrated therein, the deployable member 20 can comprise a stop element 70 that is disposed along the external surface 30 of the deployable member 20. As shown in FIG. 3, the stop element 70 can be disposed at the proximal portion 34 of the deployable member 20. In some embodiments, the stop element 70 can be configured as one or more protrusions that extend radially from the external surface 30 of the deployable member 20. In the embodiment illustrated in FIG. 3, the stop element 70 can comprise a step or lip that extends substantially circumferentially and continuously about the periphery of the deployable member 20. Additionally, although the stop element 70 is shown as extending radially from the exterior surface 30 of the deployable member 20, the deployable member 20 can be hollow and the stop element 70 can be disposed in a hollow interior of the deployable member 20. Accordingly, in some embodiments, the stop element 70 can extend inwardly.

As also shown in FIG. 3, the hub 12 can comprise a central chamber 80 that extends axially through the hub 12. It should be noted that the hub 12 can be coupled to a pole section 82. Although the hub 12 is shown in FIG. 3 as being integrally formed with the pole section 82, the hub 12 and the pole section 82 can also be separately formed. However, it is contemplated that the hub 12 and the pole section 82 can each be configured such that the central chamber 80 extends sufficiently vertically in order to allow the deployable member 20 to be at least partially received therein.

For example, it is contemplated that in embodiments wherein the hub 12 and the pole section 82 are separately formed, the hub 12 can have a sufficient vertical interior height such that the central chamber 80 extends only through the hub 12. Thus, in such an embodiment, the pole section 82 could be solid and the pole section 82 would not need to be configured such that the central chamber 80 extends through both the hub 12 and the pole section 82. However, it is also contemplated that the central chamber 80 can extend through both the hub 12 and the pole section 82, as shown in FIG. 3. The design and configuration of such embodiments can be variously manipulated as needed.

Figure 4:
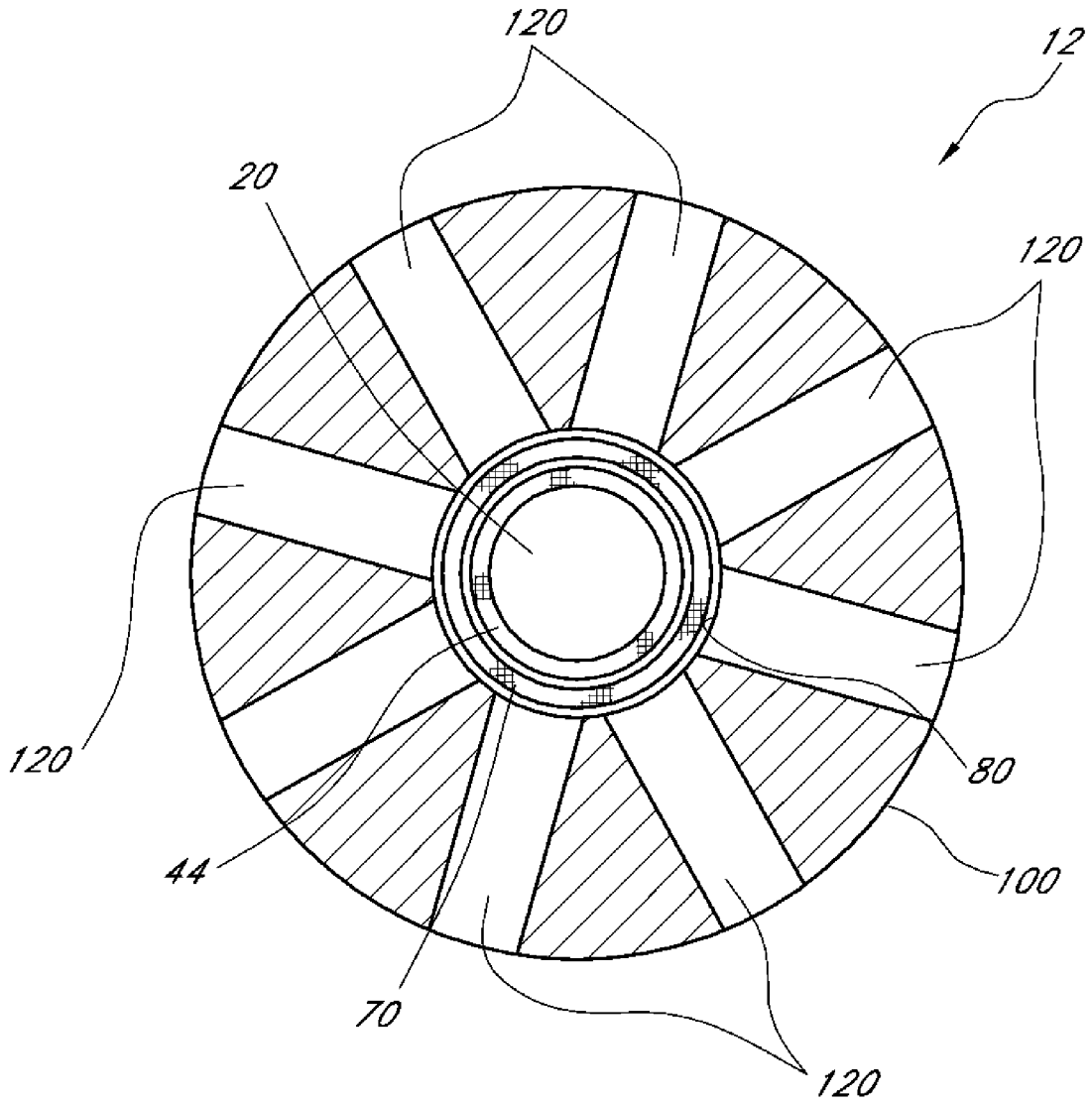
FIG. 4 is a cross-sectional top view of the light support system taken along lines 4-4 of FIG. 3.

The central chamber 80 can be configured to substantially correspond to the shape and/or cross-sectional profile of the deployable member 20. As mentioned above, the deployable member 20 can be cylindrical, and correspondingly then, the central chamber 80 can also be substantially cylindrical. Such a configuration is shown in FIG. 4, and will be described in greater detail below.

It is also contemplated that the system 10 can be configured such that the deployable member 20 is not received into a chamber of the structure. The deployable member 20 can thus be retractable from the deployed position 22 in order to not protrude downwardly from an underside of the structure. For example, in an embodiment where the system 10 is used with a pavilion, it is contemplated that the deployable member 20 need not be received into a chamber 80 of the structure, but that the deployable member 20 can move to the undeployed position 24 which simply places the deployable member 20 out of the way, and may somehow conceal the deployable member 20 as well. Furthermore, it is contemplated that the deployable member may be fabricated to include a housing which can be mounted to an underside or eave of a home or other structure, from which the deployable member 20 may extend and be received when in use.

With continued reference to FIG. 3, the system 10 can be configured such that the stop element 70 of the deployable member 20 can be engaged by a motion limiting element 90 of the hub 12. The motion limiting element 90 can be configured as one or more internally extending protrusions that define a cross-sectional profile that is less than the cross-sectional profile defined by the stop element 70. The motion limiting element 90 can also comprise an internal step or lip extending from and/or formed integrally with an interior surface 92 of the chamber 80. Thus, when the deployable member 12 is fully extended in the deployed position 22, the stop element 17 can engage the motion limiting element 90 of the hub 12, thereby limiting the motion of the deployable member 20 and preventing it from completely disengaging from the hub 12.

Nevertheless, it is contemplated that the stop element 70 and the motion limiting element 90 can comprise complementary features disposed at least partially externally to the chamber 80. Further, the motion limiting member 90 can be disposed interiorly or exteriorly to the chamber 80. Additionally, although the motion limiting member 90 is shown as extending radially inwardly from the interior surface 92 of the chamber 80, the hub 12 and/or pole section 82 can include a male mating portion that can have a radially outwardly protruding motion limiting member 90 that can interact with the stop element 70. Accordingly, in some embodiments, the motion limiting member 90 can extend outwardly.

As also shown in FIG. 3, the hub 12 can include upper and lower portions 100, 102 that can be coupled together to form the hub 12. As illustrated, the upper portion 100 can define a bottom surface 104 and the lower portion 102 of the hub 12 can define a top surface 106. The bottom and top surfaces 104, 106 can be configured to mate. Further, as shown in FIG. 3, the bottom and top surfaces 104, 106 can matably define pin apertures 110. The pin apertures 110 can be defined collectively or individually by the bottom and top surfaces 104, 106 of the respective ones of the upper and lower portions 100, 102. For example, FIG. 3 illustrates that the apertures 110 can be collectively defined when the upper and lower portions 100, 102 are positioned adjacent to each other in an assembled state. The pin apertures 110 can be configured to receive a pivot pin (not shown) of a strut of an umbrella canopy support frame.

Accordingly, the hub 12 can be assembled by inserting the deployable member 20 into a lower section 112 of the chamber 80. The stop element 70 can retain the position of the deployable member therein while the struts are appropriately positioned with the pivot pins being received into the pin apertures 110 when the upper and lower portions 100, 102 of the hub 12 are attached to each other. In some embodiments, the retention member 40 can also be attached to the distal portion 32 of the deployment member 20.

As shown in the cross-section of the system 10 and hub 12 illustrated in FIG. 4, the upper section 100 of the hub 12 can define a plurality of strut connection slots 120. The number and location of the strut connection slots 120 can be varied as necessary. FIG. 4 also illustrates that the chamber 80 can have a circular cross-section and that the stop element 70 of the deployable member 20 can have a correspondingly concentric cross-section. In addition, FIG. 4 illustrates that the deployable member 20 can be formed as a hollow cylinder.

Figure 5:
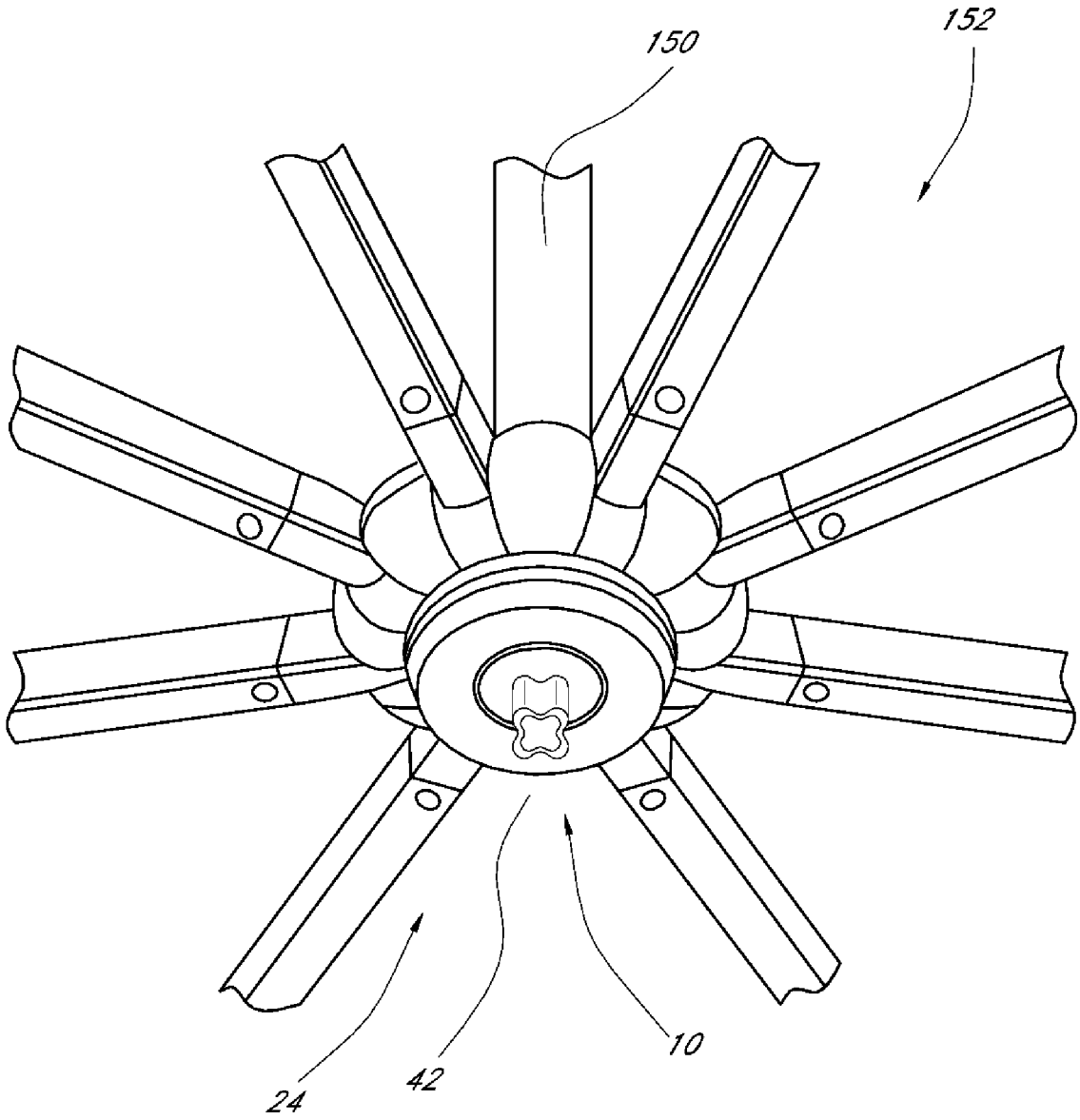
FIG. 5 is a perspective view of a light support system mounted on an outdoor cantilevered umbrella, illustrating a deployable member in a stowed position, according to an embodiment.

Referring now to FIG. 5, an embodiment of the light support system 10 is shown as being mounted on a center pole 150 of a cantilevered umbrella 152 (partially shown). FIG. 5 shows the deployable member 12 in its stowed or undeployed state 24. In accordance with some embodiments, the only visible part of the system 10 in the undeployed state 24 may be the actuator element 42. The actuator element 42 can be engaged by the user to unlock and release the deployable member 20. Once released, the deployable member 20 can move into its deployed position 22, as shown in FIG. 6.

Once in the deployed position 22 as shown in FIG. 6, the system 10 can accommodate a light device 156, as shown in FIG. 7. FIG. 7 illustrates that in an embodiment of the light support system 10, the light device 156 can be mounted on the deployable member 20 of the system 10. In such an embodiment, the only visible part of the system 10 may be the actuator element 14. Further, as mentioned above, the system 10 can be configured in various ways and therefore, can reasonably accommodate a variety of possible light devices 156. Therefore, although the light device 156 is illustrated as being a clamshell-type clamping light device, the system 10 can also be configured to include other features to which the light device 156 can be attached. For example, it is contemplated that the light device 156 may be constructed as a single part that latches onto or is otherwise connected to the system 10.

In accordance with yet another embodiment, a light support adapter can also be provided that is configured to be selectively attached to or removed from the hub of an umbrella, gazebo, pavilion, or other shade structure. In some embodiments the light support adapter can attach to a recess of the hub and a plug member can also be provided to be inserted into the recess when the light support adapter is removed therefrom. The plug member can be used at least to provide aesthetic benefits to the hub and umbrella when the light support adapter is not installed. Where the plug member provides aesthetic benefits, it may be configured as a cover. Accordingly, in some embodiments, the light support adapter and the plug member can be provided as part of a light support system. Such a system can also include a light device and an umbrella or other shade structure. The light device referred to above and herein can be configured substantially as that disclosed in U.S. Pat. No. 7,134,762 entitled "Light Providing Apparatus Attachable To Umbrella And Stand Assembly," the entirety of which is incorporated herein by reference.

Figure 8A:
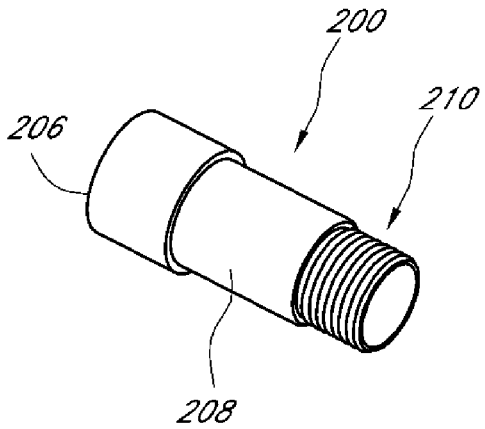
FIG. 8A is a top perspective view of a light support adapter, according to an embodiment.
Figure 8B:
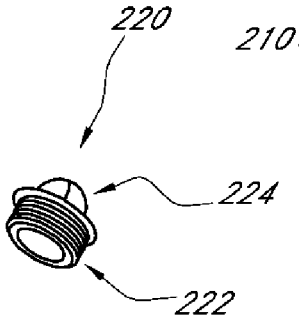
FIG. 8B is a top perspective view of a plug member, according to an embodiment.

Referring now to FIGS. 8A-8B, a light support adapter 200 and a plug member 202 are shown, respectively. The light support adapter 200 of FIG. 8A can include a first end 204 and a second end 206. The light support adapter 200 can have an elongate body defining an outer surface 208. The light support adapter 200 can include an attachment section 210 that can be configured to engage a recess of a hub of the umbrella. In some embodiments, the attachment section 210 can include a plurality of threads, and in other embodiments, the attachment section can include a single thread or other attachment surface configured to engage a corresponding engagement member of the hub. It is contemplated that the attachment section 210 can also be configured to frictionally engage the hub, such as by a pressure fit within a recess of the hub, include one or more engagement teeth that can selectively extend from the outer surface 208 of the light support adapter 200 to engage a portion of the hub, or utilize other such mechanisms to provide a secure attachment of the light support adapter 200 to the hub of the umbrella.

Figure 9:
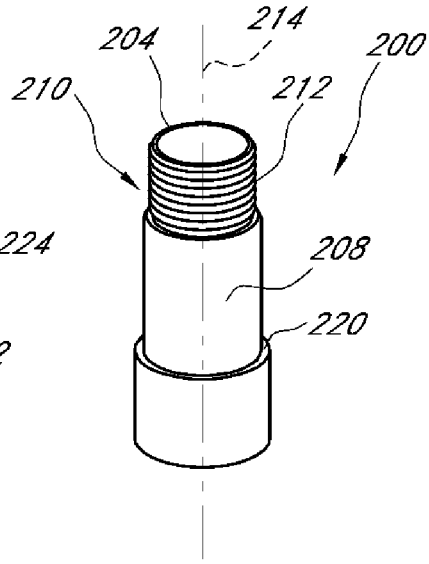
FIG. 9 is a front perspective view of the light support adapter of FIG. 8A, according to another embodiment.

FIG. 9 illustrates an embodiment of the light support adapter 200 wherein the light support adapter 200 comprises an attachment section 210 having a plurality of threads 212 disposed adjacent the first end 204 of the light support adapter 200. The threads 212 can be used to attach the light support adapter 200 to the hub in some applications. The light support adapter 200 can also define a longitudinal axis 214, and the light support adapter 200 can be coupled to the hub such that the longitudinal axis 214 is in a fixed orientation relative to the longitudinal axis of the hub (described further below). For example, the two axes can be coaxially aligned as shown in FIGS. 10C-10D.

Additionally, FIG. 9 illustrates that in some embodiments, the outer surface 208 of the light support adapter 200 can include at least one light engagement feature that is configured to facilitate the engagement of the light device with the outer surface 208 of the light support adapter 200. For example, in FIG. 9 the light support adapter 200 is shown as including a circumferentially extending ledge 220 that protrudes radially from the outer surface 208 of the light support adapter 200. As shown, the ledge 220 can be used to engage a corresponding engagement member of the light device to support the light from below. In one application, the ledge 220 can work together with a clamping mechanism of a light (for example the clamp of the above-referenced U.S. Pat. No. 7,134,762) such that the light is supported from below and clamped to frictionally engage the surface 208 in order to ensure that the light device maintains its vertical position along the light support adapter 200.

In some embodiments, it is contemplated that the light support adapter 200 can be configured to support the light device in an orientation perpendicular to the longitudinal axis of the hub of the umbrella. For example, the outer surface 208 can support the light device with a clamp of the light device exerting an inwardly directed radial force that is oriented substantially perpendicular relative to the longitudinal axis of the hub and/or of the light support adapter 200. Indeed, the light device can be attached perpendicularly relative to the longitudinal axis 214 of the light support device 200.

In other embodiments, the outer surface 208 of the light support adapter 200 can be configured to engage with interior geometry of the light device. For example, the interior geometry of an aperture of the light device can be configured as a cylinder having a diameter being approximately less than the outer diameter of the ledge 220 of the light support adapter 200. In such an embodiment, the light support adapter 200 could be inserted into the aperture of the light device and the light device could be attached to the umbrella hub by simply attaching the light support adapter 200 to the hub. Other modifications such as complementary conical structures and other variations are contemplated and can be configured provided the disclosure herein.

Referring again to FIG. 8B, the plug member 202 can include an attachment section 222 and a user operable section 224. As discussed above with respect to the light support adapter 200, the attachment section 222 of the plug member 202 can be configured in a variety of ways. As illustrated, the attachment section 222 of the plug adapter 202 can be configured to include a plurality of threads. In addition, the user operable section 224 can be configured to facilitate the insertion and attachment of the plug member 202 into a recess of the hub. For example, in some embodiments, the user operable section 224 can be configured substantially as a cube or other geometric feature that allows the user to engage the plug member 202 with their hand or a tool in order to facilitate insertion and attachment of the plug member 202 into the recess of the hub.

Figure 10A:
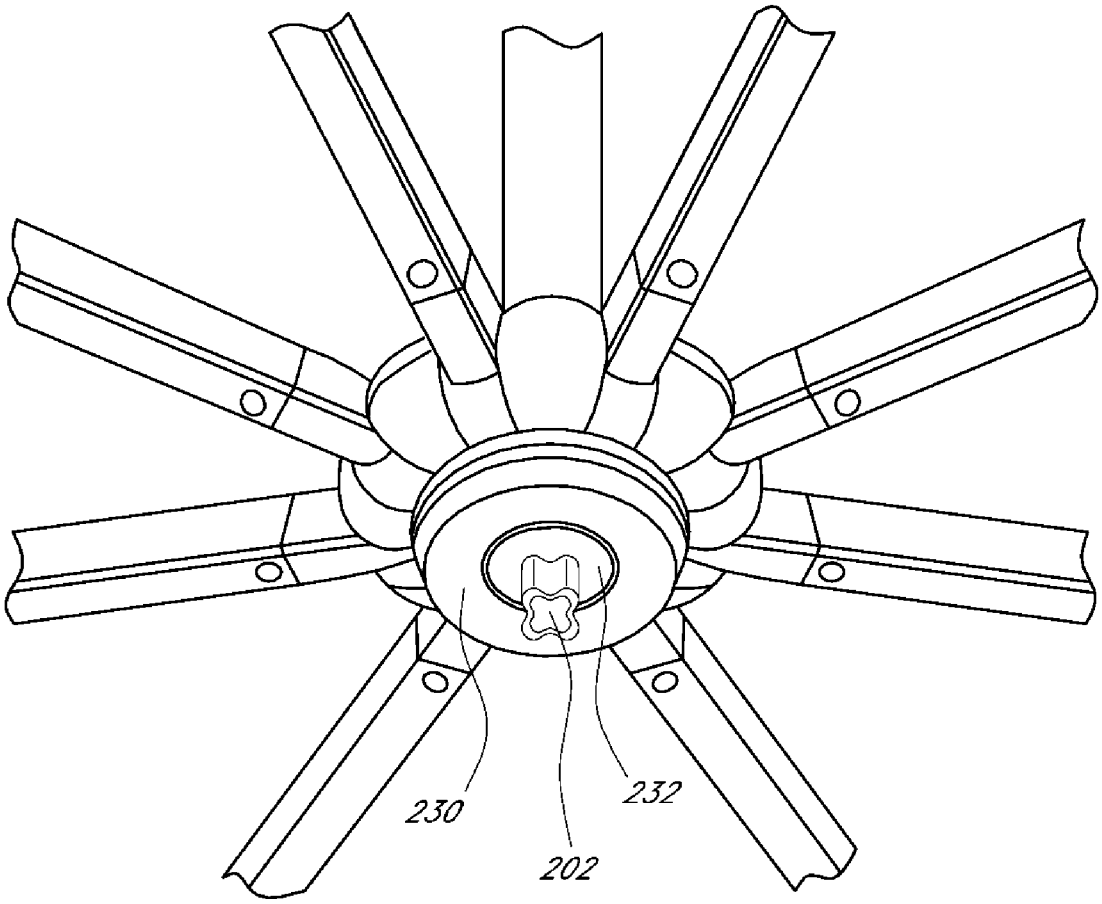
FIG. 10A is a perspective view of an umbrella hub having the plug member disposed in a recess thereof, according to an embodiment.
Figure 10B:
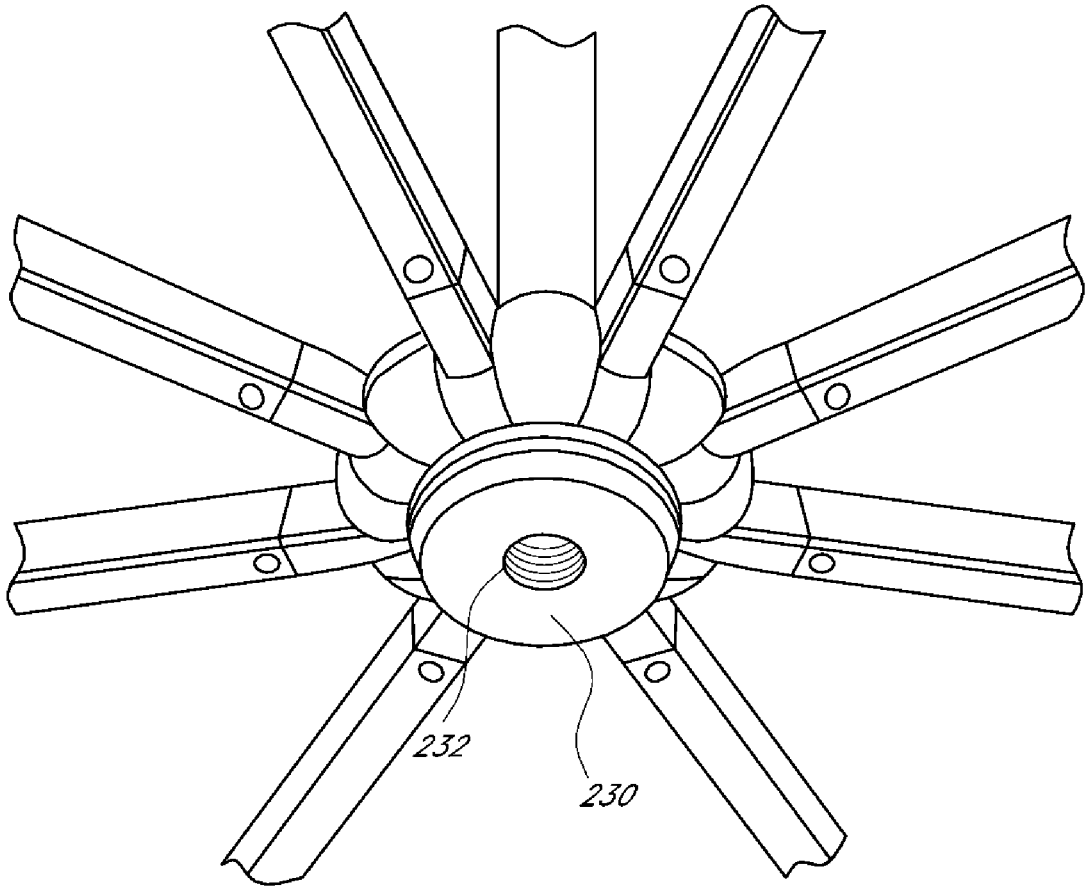
FIG. 10B is a perspective view of the umbrella hub of FIG. 10A without either of the plug member or the light support adapter disposed in the recess thereof.
Figure 10C:
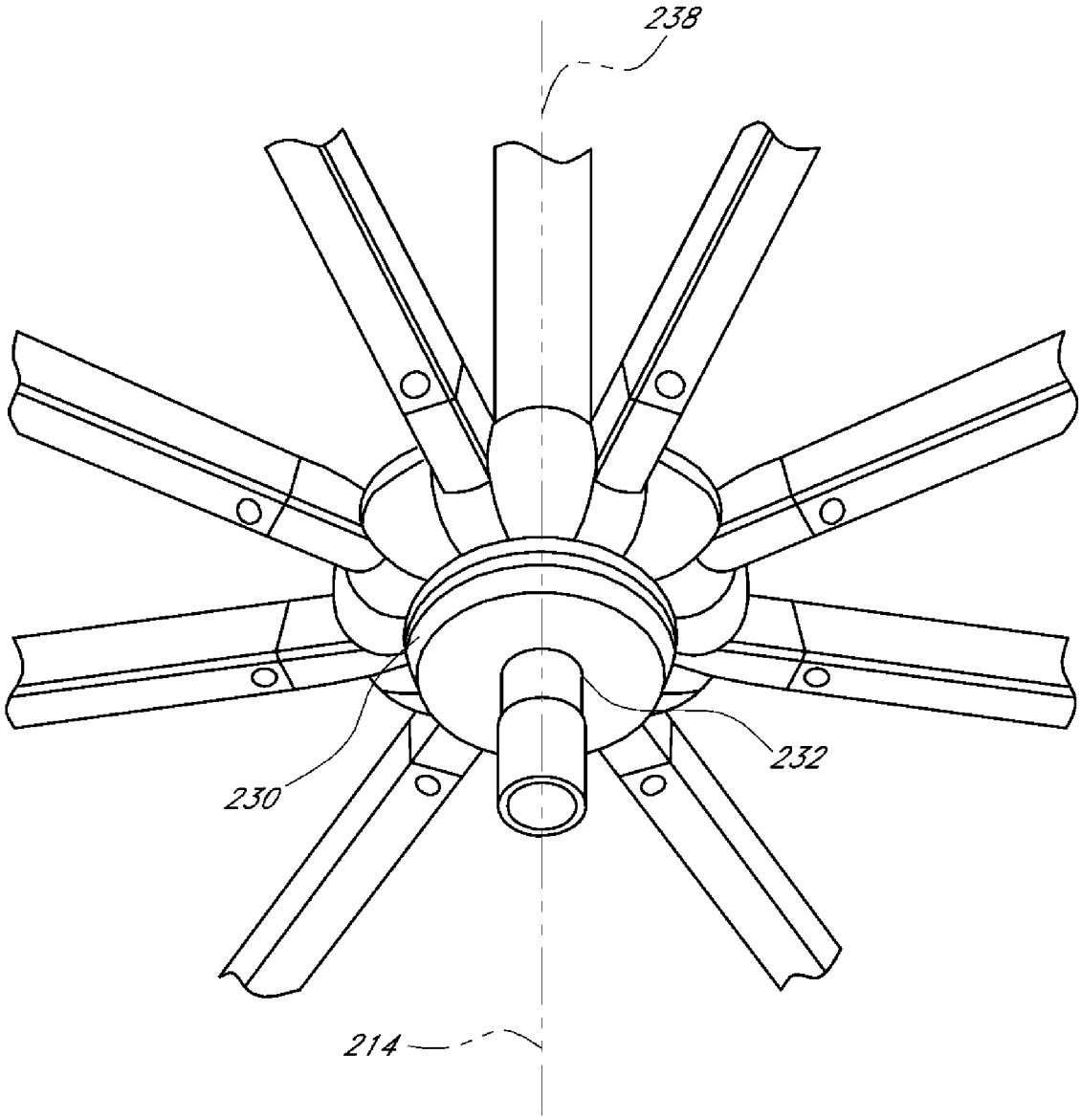
FIG. 10C is a perspective view of the umbrella hub of FIG. 10A with the light support adapter disposed in the recess thereof.
Figure 10D:
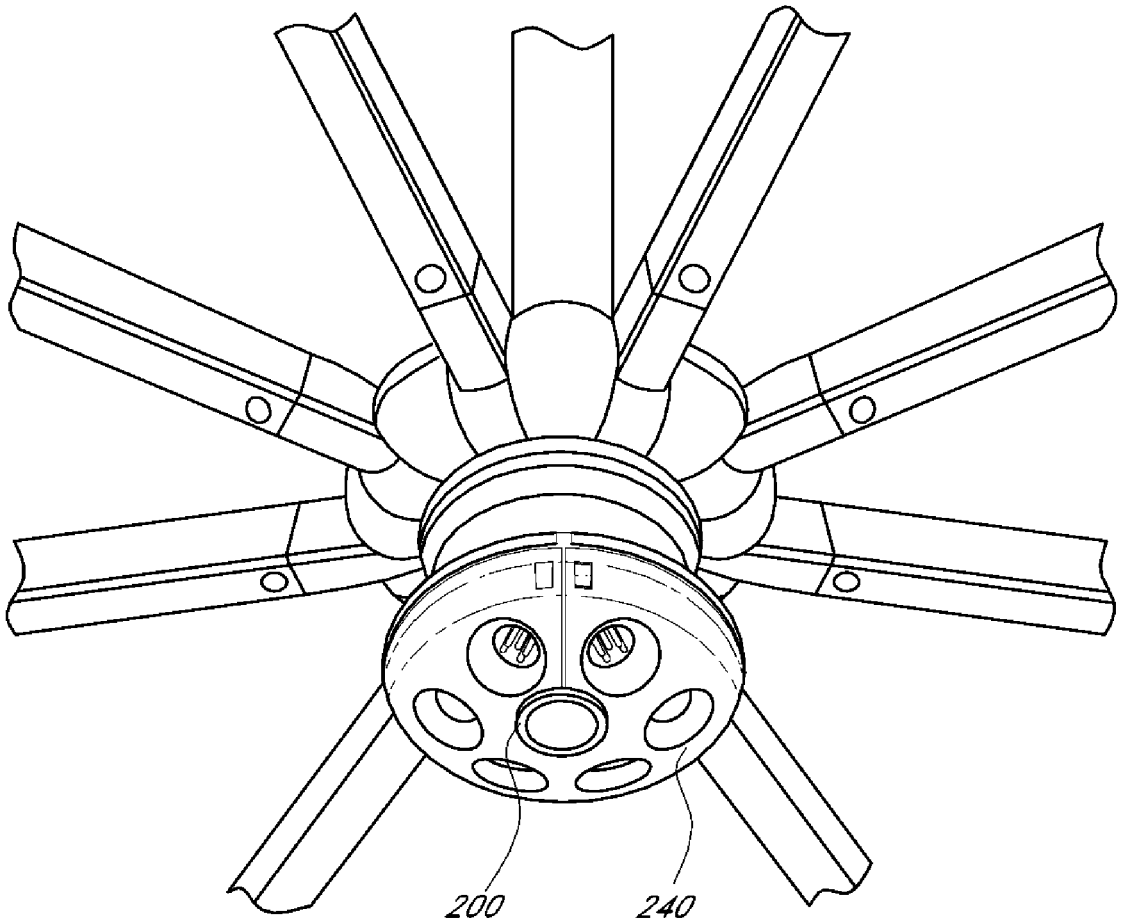
FIG. 10D is a perspective view of the umbrella hub of FIG. 10A with the light support adapter disposed in the recess thereof and with a light device suspended from the light support adapter, according to an embodiment.

Referring now to FIGS. 10A-10D, an illustration is provided of an example use of an embodiment of the light support adapter 200 and the plug member 202. In FIG. 10A, an umbrella hub 230 is shown having a recess 232 into which the plug member 202 has been inserted. FIG. 10B is an illustration of the hub 230 wherein the recess 232 is exposed and has neither the light support adapter 200 nor the plug member 202 inserted therein.

FIG. 10C is an illustration of the light support adapter 200 inserted into the recess 232 of the hub 230. As shown in FIG. 10C, in one embodiment when the light support adapter 200 is attached to the hub 230, the longitudinal axis 214 of the light support adapter 200 is substantially coaxially aligned with a longitudinal axis 238 of the hub 230. It is also contemplated that the light support adapter 200 can be attached to the hub 230 at a variety of other locations such that the longitudinal axis 214 of the light support adapter 220 is fixed relative to the longitudinal axis 238 of the hub 230.

Finally, FIG. 10D illustrates a light device 240 being attached to the light support adapter 200. In such a case, both the light device 240 and the light support adapter 200 can be attached to and suspended from the umbrella hub 230.

In another embodiment, a light can be provided that can mount beneath a shade structure having a canopy. The canopy can have an upper hub and a lower hub with a lower surface. The hub can define a longitudinal axis, and the lower surface of the lower hub having a recess formed therein, as described above. In some shade structures where the canopy does not articulate as in an umbrella, a support member that need not take the form of a hub can be provided with a recess capable of receiving the adapter. For example, a pavilion having a frame could be provided with a support member (e.g., a frame member or other structure) with such a recess. In this embodiment, the light can comprise the light support adapter 200 and a housing (shown in FIG. 10D).

In such an embodiment, the adapter 200 can have the first end 204, which can be engagable with the recess of the hub or other support member, and the second end 206 opposite the first end 204. The adapter 200 also can include the outer surface 208 between the first and second ends 204, 206 and extend along its longitudinal axis 214 and having a length between the first and second ends 204, 206 such that the second end 206 is beneath the lower hub but does not support the canopy in use. The housing can have an inner sidewall surface defining an opening configured to receive the second end 206 of the adapter such that the opening substantially surrounds the adapter longitudinal axis 214. Further, the light can include at least one light source carried by the housing and a clamp for engaging the light to the outside surface 208 of the adapter 200 in a direction substantially perpendicular to the axis 214 of the adapter. The clamp can extend in said direction from the inner sidewall surface.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A light support system for an outdoor shade structure, the system comprising:

a support hub having a chamber;

a light support member having an exterior surface and proximal and distal portions, the light support member being positionable into the chamber of the support hub to assume a stowed position in which the distal portion of the light support member is positioned adjacent to an opening of the chamber and a portion of the exterior surface of the light support member is concealed within the chamber, the light support member being extendable from the chamber to assume a deployed position in which the proximal portion of the light support member is positioned adjacent to the opening of the chamber and the portion of the exterior surface of the light support member is exposed, the exterior surface of the light support member being configured to couple with a lighting device such that the light support member can support the lighting device when the light support member is in the deployed position; and a retention mechanism being configured to facilitate locking and unlocking of the light support member to restrain the light support member at least in the stowed position, the light support member being restrained relative to the support hub when the retention mechanism locks the light support member at least in the stowed position.

2. The light support system of claim 1, wherein the retention mechanism is disposed at the distal portion of the light support member.

3. The light support system of claim 1, wherein the retention mechanism is attached to the light support member.

4. The light support system of claim 1, further comprising an actuator element being configured to facilitate movement of the light support member from at least one of the stowed position to the deployed position and the deployed position to the stowed position, the actuator element being configured to allow a user to actuate the retention mechanism for locking and unlocking the light support member.

5. The light support system of claim 4, wherein the actuator element is a grippable portion disposed along the exterior surface of the light support member.

6. The light support system of claim 5, wherein the grippable portion is a knob having a gripping surface.

7. The light support system of claim 6, wherein the light support member has a longitudinal axis and the knob extends along that axis away from the distal portion of the light support member.

8. The light support system of claim 1, wherein the light support member is generally cylindrical.

9. The light support system of claim 1, wherein the light support member has a longitudinal axis and an outer surface extending in the direction of that axis configured to accept a light that frictionally engages that surface and extends around the axis.

10. The light support system of claim 1, wherein the light support member has a longitudinal axis and is configured to move between the stowed and deployed positions generally along that axis.

11. The light support system of claim 1, wherein the light support member includes a stop element disposed on the exterior surface at the proximal end thereof to limit longitudinal displacement of the light support member.

12. The light support system of claim 11, wherein the stop element is engageable by a motion limiting element disposed on the interior surface of the chamber of the support hub.

13. The light support system of claim 12, wherein the stop element is a protrusion extending radially from the light support member.

14. The light support system of claim 13, wherein the stop element is a lip that extends circumferentially about the light support member.

15. The light support system of claim 1, wherein the support hub is an umbrella hub having a top and a bottom and a plurality of apertures for receiving ribs of an umbrella canopy support frame, and wherein the chamber extends axially in the hub, the light support member being positionable in the chamber to assume a stowed position.

16. The light support system of claim 15, wherein the hub includes upper and lower portions disposed at the respective ones of the top and bottom ends, the upper portion having a bottom surface being configured to mate with a top surface of the lower portion, the upper and lower portions defining the plurality of pin apertures, the upper and lower portions further defining the central chamber.

17. The light support system of claim 15, wherein the retention mechanism is removably attachable to the distal portion of the light support member, the light support member having a stop element disposed at the proximal portion thereof, the light support member being insertable into a lower section of the chamber defined by the lower portion of the hub with the retention mechanism being attached to the light support member such that the stop element and the retention mechanism limit longitudinal movement of the light support member relative to the lower portion of the hub.

18. The light support system of claim 1, wherein the retention mechanism comprises a plurality of threads being configured to threadingly attach to a corresponding plurality of threads disposed within a lower section of the chamber.

19. A method of supporting a lighting device on an umbrella, the method comprising:

deploying a light support member from a stowed position within a chamber of a support hub in which an exterior surface of the light support member is concealed within the chamber, toward a deployed position in which the light support member extends from the chamber of the support hub to expose the exterior surface of the light support member;

restraining the light support member relative to the hub to limit movement of the light support member relative to the hub in at least the deployed position; and attaching the lighting device to the light support member when the light support member is in the deployed position.

20. The method of claim 19, further comprising the step of unlocking the light support member from engagement with the support hub in the stowed position to permit the light support member to be moved to the deployed position.

21. The method of Claim 20, further comprising gripping an actuator element to rotate a retention of the light support member for locking and unlocking the light support member in the stowed position.

22. A light support system for an outdoor shade structure, the system comprising:

a support hub defining a chamber and an engagement section;

an elongate deployable member being positionable within the chamber of the support hub in a stowed position, the deployable member being movable from the stowed position to a deployed position to expose an exterior surface of the deployable member, the deployable member being configured to support a lighting device when the deployable member is in the deployed position; and a retention mechanism being coupled to the deployable member, the retention mechanism configured to restrain the deployable member relative to the support hub when the deployable member is positioned at least in the stowed position.

23. The system of claim 22, wherein the deployable member further comprises a stop element configured to be engaged by an interior surface of the chamber of the support hub when the deployable member is in the deployed position to limit movement of the deployable member beyond the deployed position.

24. The system of claim 23, wherein the stop element comprises a radially extending lip.

25. The system of claim 23, wherein the stop element of the deployable member is a protrusion that extends radially from a proximal portion of the deployable member for engaging a motion-limiting element of the support hub.

26. The system of claim 25, wherein the support hub comprises upper and lower portions that define the chamber, the upper portion having a bottom surface being configured to mate with a top surface of the lower portion, and wherein the motion-limiting element is a lip disposed on the lower portion of the hub that extends radially inwardly into the chamber.

27. The system of claim 22, wherein the engagement section of the support hub comprises threads.

28. The system of claim 27, wherein the retention mechanism comprises a threaded portion configured to engage with the threads of the engagement section of the support hub.

29. The system of claim 28, wherein the deployable member further comprises an actuator knob for rotating the deployable member to facilitate engagement of the retention mechanism with the hub.

30. The system of claim 22, wherein in the stowed position, a distal portion of the light support member is positioned adjacent to an opening of the chamber and the exterior surface of the light support member is concealed within the chamber.

31. The system of claim 22, wherein the chamber and the deployable member are generally cylindrical.

32. The system of claim 22, wherein the deployable member is configured to mate with a portion of the retention mechanism for securing the retention mechanism to the deployable member.

33. The system of claim 32, wherein the deployable member is hollow and defines an interior dimension configured to receive an upper portion of the retention mechanism, the system further comprising a screw for securing the retention mechanism to the deployable member.

* * * * *